United States Patent [19]

Gillis

[11] 4,265,260

[45] May 5, 1981

[54] FLEXIBLE VAULT STRUCTURE

[76] Inventor: Robert E. Gillis, P. O. Box 67, Aptos, Calif. 95003

[21] Appl. No.: 50,981

[22] Filed: Jun. 22, 1979

[51] Int. Cl.[3] ..... A45F 1/16

[52] U.S. Cl. ..... 135/3 R; 52/80

[58] Field of Search ..... 135/1, 3, 4; 52/80, 52/81

[56] References Cited

U.S. PATENT DOCUMENTS

| | | | |
|---|---|---|---|
| 2,938,524 | 5/1960 | Benson | 135/3 E X |
| 3,892,094 | 7/1975 | Spray | 135/3 R X |
| 3,951,159 | 4/1976 | Robinson et al. | 135/1 R X |
| 3,986,519 | 10/1976 | Gillis | 135/3 E |
| 4,068,404 | 1/1978 | Sheldon | 135/1 R X |
| 4,128,104 | 12/1978 | Corey | 135/1 R |

*Primary Examiner*—J. Karl Bell

*Attorney, Agent, or Firm*—Robert G. Slick

[57] ABSTRACT

A flexible vault structure is provided which includes a plurality of stressed poles which are held in their stressed condition by a member, usually a membrane, strung between the poles. The vault structure can be used as a storage vessel, tent, kite or the like.

6 Claims, 8 Drawing Figures

FLEXIBLE VAULT STRUCTURE

SUMMARY OF THE INVENTION

The present invention relates to a vault structure wherein a plurality of poles are provided in a criss-cross configuration wherein the poles are under tension which tension is maintained in a preferred embodiment by a flexible membrane. Instead of the flexible membrane, the poles can be maintained under tension by means of wires, nets or similar tension elements.

The structures of the present invention are free standing; that is, they form a free-standing cell which requires no guy wires, stakes or the like to aid in their support. They consist of arched, intersecting poles connected to a membrane, fabric or net in a manner that permits the poles to slide within such means easily when desired.

The structures of the present invention have a variety of uses such as as a tent, a storage vessel, a kite, boat or the like.

Preferably, the structures of the present invention are of generally rectangular configuration when viewed from above and are in the form of a semi-circle in section.

Normally, the poles are held in tension by means of a membrane or skin such as a plastic sheet material of polyethylene, vinyl and the like, or a woven fabric such as cotton, nylon or polyester; but in addition to the membrane, the poles can be held in tension by means of cords, wires, net or cables which pass under the poles. Since the most common configuration of the invention is the use with a membrane, as in a tent, in the specification a membrane is frequently referred to; but in each instance, it will be understood that one need not have a continuous membrane but instead a cord or rope can be strung under the poles to hold them in tension.

In forming structures of the present invention, the poles will cross each other at a number of points and at a plurality of such points, preferably at all crossings, the poles will be attached to the membrane or skin by means of a sliding arrangement hereinafter described.

The sliding arrangement can be a simple loop which passes over a pair or more of crossed poles, or it can be in the form of sleeves which are woven into the fabric of the membrane or they can be rings or other forms of loops which hole two or more crossed poles and which serve to attach the crossing to the membrane in such a way that the poles can move to some extent through the attachment means.

A particularly advantageous form of attachment means is a clip such as is set forth in my co-pending patent application, Ser. No. 825,410, filed Aug. 17, 1977 now U.S. Pat. No. 4,175,305.

The poles themselves could be in one piece, or they can formed of a plurality of sections with suitable coupling means. The poles can be of fiberglass, aluminum rod or tubing, wood strips, bamboo or almost any flexible material. When several strips are fastened together, any known fastening means can be employed; and coupling sleeves are particularly advantageous, although in many instances it is sufficient to merely lap the joints and tie them together.

Many other variations and uses of the invention will be apparent from the balance of the specification.

DESCRIPTION OF THE PREFERRED EMBODIMENTS

Figure 1:
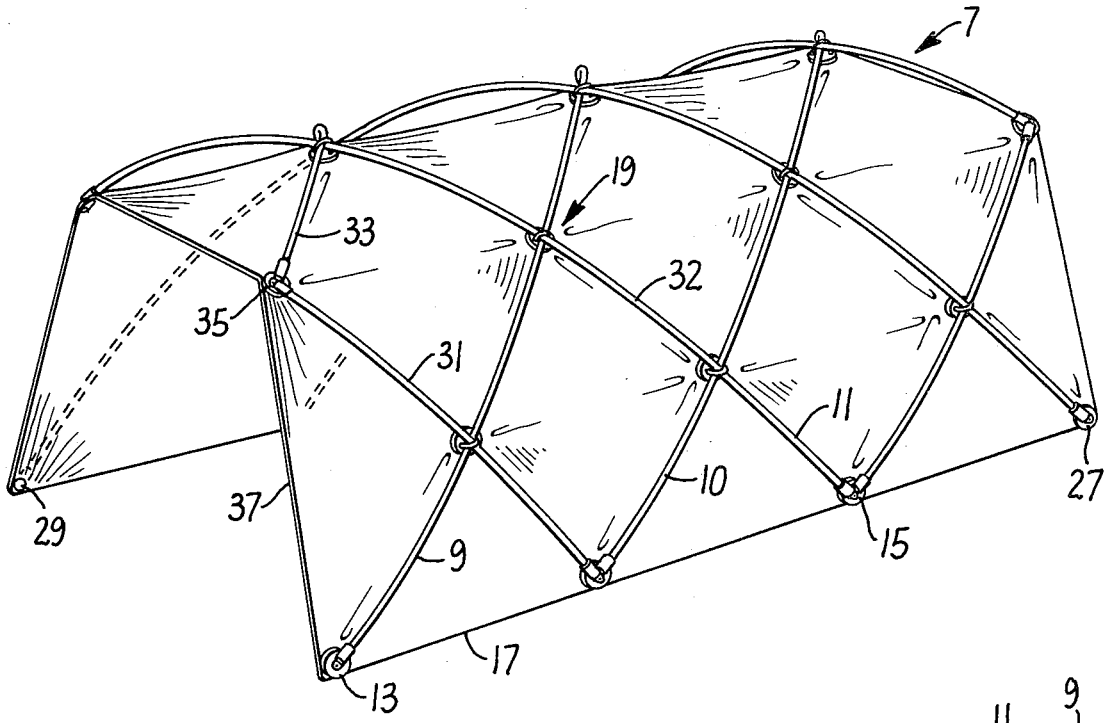
FIG. 1 is a perspective view of a vault structure embodying the present invention in the form of a short tunnel.
Figure 2:
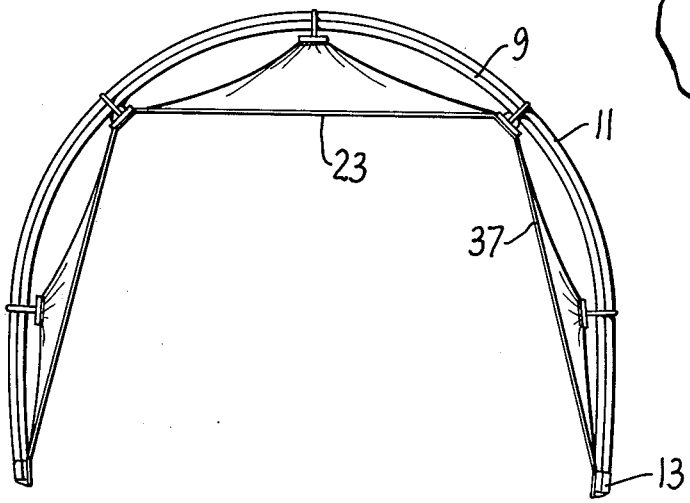
FIG. 2 is a section through the center of the vault structure shown in FIG. 1.

Referring now to the drawings by reference characters and particularly to FIGS. 1 and 2, there is shown a vault structure, generally designated 7, which in cross section has a generally arch shape as best seen in FIG. 2. A plurality of poles such as those designated 9 and 11 extend upwardly from the bottom points 13 and 15 of a terminal edge 17 over and completely across the vault. A typical pole crossing is shown at 19 and is shown in detail in FIG. 3. Here a ring 21 has been fastened to the membrane 23 by means of an element which fits within the ring (not illustrated) in accordance with my co-pending patent application Ser. No. 825,410. Ring 21 includes a loop 25 which passes over the poles 9 and 11 and holds them loosely together allowing each of the poles to slip within the loop 25. The poles themselves are held in tension by the fabric 23 and the method by which this is accomplished is best seen in FIG. 2. Here the fabric 23 acts as a geometric cord between arcuate segments of the poles 9 and 11. At first glance, it would seem that the structure would flatten out because of the tension of the poles, but it is obvious from FIG. 2 how the arcuate poles are held in tension. A plurality of the poles start at one bottom edge 27 and extend in arcuate form over the top of the vault structure and terminate at an opposite edge 29. Other poles such as pole 31 and 33 may terminate at an edge other than the bottom edge as is shown at connector 35. This connector, of course, is connected to a terminal edge 37 of the membrane.

Figure 8:
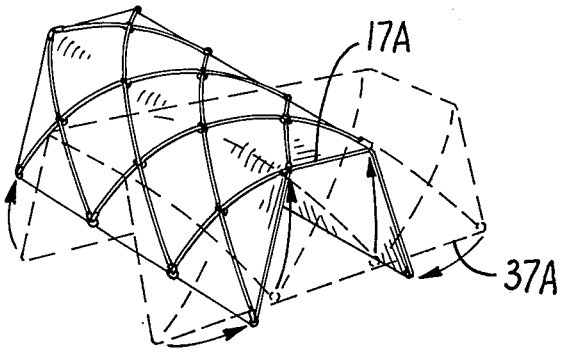
FIG. 8 is a diagrammatic view showing the "flip-flop" nature of the vault structure of the present invention showing how one may spring the axis of the vault 90°.

One peculiarity of the vault structure of the present invention is that if sufficient stress is put on the end members, it will flip to a configuration 90° removed from its former position. This is shown in FIG. 8 wherein the structure shown in solid lines can be "flipped" to that shown in solid lines. Thus, by putting tension on the device, it will flip suddenly to a new stable position wherein the former bottom edge 17 forms a mouth 17A of the vault while the edge 37, which was the mouth edge of the vault, becomes the bottom edge as is shown at 37A in FIG. 8.

Figure 4:
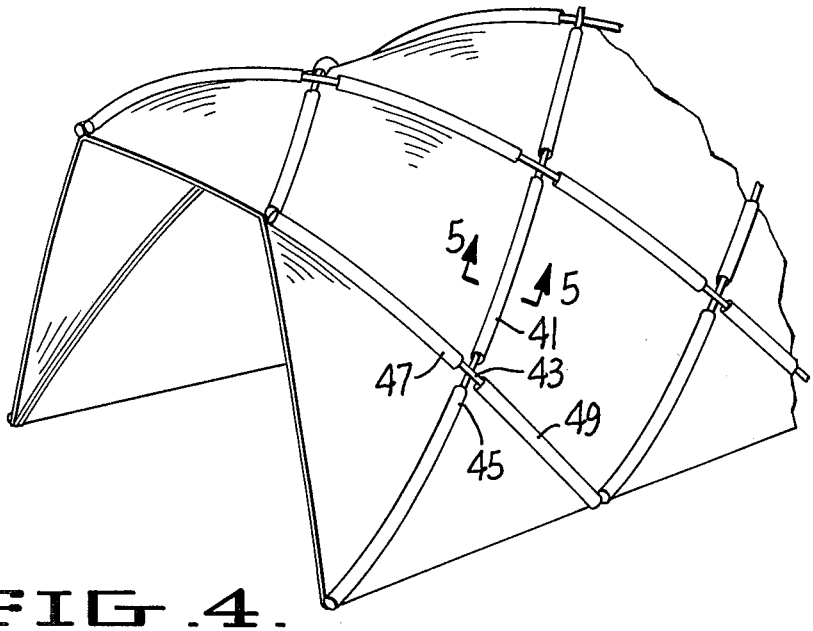
FIG. 4 is a partial perspective view of a vault structure showing the use of sleeves to engage the poles.
Figure 5:
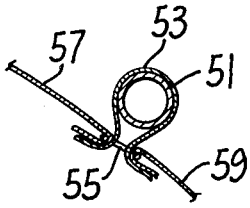
FIG. 5 is an enlarged section on the line 5—5 of FIG. 4.

In FIGS. 4 and 5 an embodiment of the invention is shown wherein sleeves are used which lie substantially the entire length of the web except for those portions where the poles cross. For instance, sleeve 41 terminates just short of the pole crossing designated 43 and continues just beyond the crossing as at 45. Similiarly, sleeve 47 terminates just short of the pole crossing while sleeve 49 lies on the opposite side. The sleeves can be made of the same or a different fabric from that of the tent itself and can be either sown on the surface or, as is shown in FIG. 5, can be sown into the seams. Thus, at FIG. 5 pole 51 is surrounded by sleeve 53 and this is united by the stitching 55 to two adjacent panels 57 and 59 of tent fabric. The distance between the two panels is exaggerated for illustration purposes.

Figure 6:
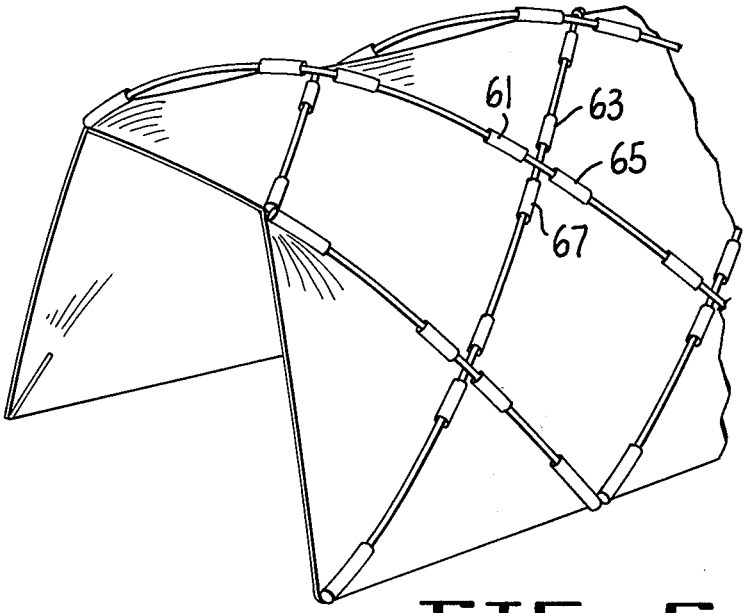
FIG. 6 is a perspective view, similar to FIG. 4 showing short sleeves to engage the poles.

FIG. 6 shows a similar structure but here short sleeves as at 61, 63, 65 and 67 surround each of the pole crossings. Here again, the sleeves can be sown onto the surface or into a seam.

Figure 3:
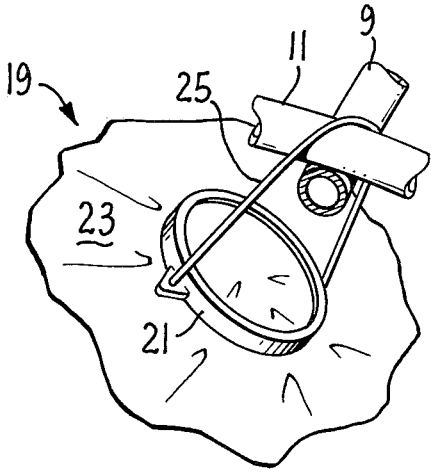
FIG. 3 is an enlarged detailed view showing a preferred method of fastening a pair of crossed poles to a membrane.
Figure 7:
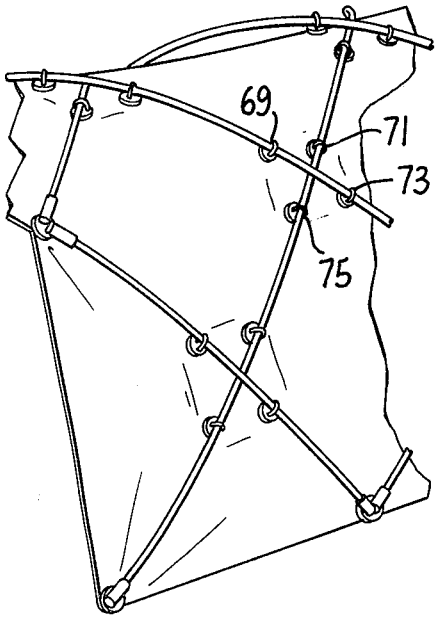
FIG. 7 is an partial view of a vault structure showing the use of clips, similar to the clips shown in FIG. 1 except that the clips are employed adjacent to crossings rather than engaging two crossed poles.

In FIG. 7 a plurality of fasteners such as those shown in my copending patent application Ser. No. 825,410 are employed. However, instead of being employed as is shown in FIGS. 1 and 3 wherein the loop 25 embraces two crossed poles, individual loops are used at the crossing. Thus, at a typical crossing loops 69, 71, 73 and 75 are employed.

In preferred embodiments of the invention, a plurality of rods are employed wherein the series are paired so that within each set of rods the rods are parallel, e.g. rods 9 and 10 of FIG. 1, while a second set of rods are parallel with each other and run at an angle to the first set of rods, e.g. rods 31 and 32 of FIG. 1. This is a preferred configuration, but it is not necessary that the rods be parallel.

Although the poles are preferably in parallel sets running at an angle to each other, this configuration is not necessary, and they can be in random distribution, and it is not necessary that any of the poles be parallel with each other.

Although a specific fastening means to the membrane has been shown, other forms can be used such as sleeves or rings or loops which are sown into the fabric or which are clamped on each side of the skin.

The skin itself can be a plastic sheet material such as polyethylene, vinyl or the like or a woven fabric such as cotton, nylon, polyester or the like, or it can be even a wire, cord or a cable network under the poles.

It is believed apparent from the foregoing that I have provided a flexible structure having many utilities. This flexible structure can be used as a boat, as a kite, as a storage vessel, as a tent, greenhouse, storage room or the like.

I claim:

1. A vault structure having an arcuate shape in cross section, a generally rectangular shape in plan, said vault structure extending from a plane and having no member from side-to-side in said plane comprising in combination:

a. A plurality of rod-like members, b. each of such rod-like members being held in tension by stress means and thereby formed into a generally arcuate shape and a plurality of said rod-like members extending from the level of the plane on one side, over the top of the arcuate structure to the level of the plane on the opposite side, c. said stress means comprising a flexible member attached to said rod-like members by means of a sliding connection and d. said stress means forming a plurality of geometric cords with respect to said arcuate rod-like members.

2. The vault structure of claim 1 wherein the flexible member is a membrane of a flexible material such as a plastic sheet, typically polyethylene, vinyl and the like, or a woven fabric such as cotton, nylon or polyester.

3. The vault structure of claim 1 wherein the sliding connection comprises a clip fastened to a fabric with a flexible loop encompassing a plurality of pole crossings.

4. The vault structure of claim 1 wherein the sliding connection comprises a series of sleeves extending from one pole crossing to the next.

5. The structure of claim 1 wherein the sliding connection comprises a plurality of clips located on each side of a pole connection.

6. The structure of claim 1 wherein the sliding connection includes a plurality of short sleeves, one sleeve being adjacent to each pole at each pole crossing.

* * * * *